United States Patent [19]

Tomita

[11] Patent Number: 4,895,402

[45] Date of Patent: Jan. 23, 1990

[54] DEVICE FOR SEALING COIN CONTAINING BAG OR THE LIKE

[75] Inventor: Sumio Tomita, Toyonaka, Japan

[73] Assignee: Takako Tange, Nara, Japan

[21] Appl. No.: 177,757

[22] Filed: Apr. 5, 1988

[30] Foreign Application Priority Data

May 7, 1987 [JP] Japan ..... 62-111983

[51] Int. Cl.[4] ..... B65D 77/10

[52] U.S. Cl. ..... 292/307 R; 24/30.5 R; 292/325

[58] Field of Search ..... 24/30.5 R, 117, 136 R, 24/136 C; 292/307 R, 316, 317, 318, 319, 320, 321, 322, 323, 325

[56] References Cited

U.S. PATENT DOCUMENTS

| | | | |
|---|---|---|---|
| 719,865 | 2/1903 | Porter | 292/325 |
| 1,396,479 | 11/1921 | Tyden | 24/30.5 R |
| 2,163,660 | 6/1939 | Brooks | 24/30.5 R |
| 2,709,613 | 5/1955 | Moberg | 292/325 |
| 3,132,390 | 5/1964 | Boden | 24/117 R X |
| 3,845,575 | 11/1974 | Boden | 24/117 R X |
| 4,102,019 | 7/1978 | Boden | 24/117 |
| 4,175,782 | 11/1979 | Lima | 292/307 R |
| 4,527,308 | 7/1985 | Tritton et al. | 24/30.5 R |
| 4,610,053 | 9/1986 | Tomita | 24/30.5 R |
| 4,680,835 | 7/1987 | Horng | 24/117 |

FOREIGN PATENT DOCUMENTS

| | | | |
|---|---|---|---|
| 2500926 | 7/1973 | Fed. Rep. of Germany | 24/30.5 R |
| 63-37559 | 3/1988 | Japan . | |

*Primary Examiner*—Gary L. Smith
*Assistant Examiner*—Eric K. Nicholson
*Attorney, Agent, or Firm*—Armstrong, Nikaido, Marmelstein, Kubovcik & Murray

[57] ABSTRACT

The present invention relates to a device for sealing coin containing bag or the like and particularly provides a device for sealing coin containing bag or the like which comprises a case that can easily be formed and other constituent members that can easily be assembled, and which exhibits good operating properties and can easily be manufactured at a low price.

8 Claims, 8 Drawing Sheets

DEVICE FOR SEALING COIN CONTAINING BAG OR THE LIKE

BACKGROUND OF THE INVENTION

1. Field of the Invention

The present invention relates to a device for sealing coin containing bag or the like.

2. Description of the Prior Art

The inventor has previously proposed a device for sealing coin containing bag or the like which comprises a case having a hollow portion, a presser piece received in the hollow portion, and a string (Japanese Patent Laid-Open No. 232589/1985). However, this previous proposition has problems in that the case is not easily formed because it is provided with a front wall having a hole through which the string is passed and a wide opening at its rear position, and it is relatively difficult to insert the string into the case when the sealing device is assembled. Therefore, the sealing device has poor operating properties and is not easily manufactured.

In addition, the inventor has proposed a device for sealing coin containing bag or the like as disclosed in Japanese Patent Laid-Open No. 109320/1986 (Application Date: May 21, 1986).

This sealing device has a prismatic case having openings at the front and rear, projections for pressing a string which are provided on the left and right sides, a piece for pressing the string which is fixed to the case in a state wherein the piece is inserted into the case from the opening at the rear, and the string which is folded so as to be wound around the object to be sealed such as a coin containing bag. This sealing device is characterized in that walls which project inward are provided on the left and right sides of the opening at the front end of the prismatic case; the piece for pressing the string has a front wall, which is provided on its front in such a manner that it is inserted into a central portion of the opening at the rear of the case, and walls which project inward and are provided on the left and right sides of the front wall; and crooked spaces through which the left, right, and intermediate portions are passed are formed between the projecting walls at the front of the case with the left and right side walls thereof and the front wall and the left and right projecting walls of the presser piece. However, this sealing device has a problem in that it is possible to illicitly extract the string from the case and replace it with a new string because a substantially intermediate portion of the string is held at the rear of the case in a state wherein the string is exposed to the outside.

SUMMARY OF THE INVENTION

It is an object of the present invention to provide a sealing device for a coin containing bag which has none of the problems described above, which comprises a case that can be easily formed and other constituent members that can be easily assembled, which therefore exhibits good working properties, and which can easily be manufactured at a low price.

It is another object of the present invention to prevent illicit extraction and replacement of a string from a case.

To the above-described ends, the present invention provides a device for sealing coin containing bag or the like which comprises a prismatic case having openings at the front and rear; a string pressing piece which has string pressing portions on its left and right sides and which is fixed to the case in a state wherein it is inserted into the case through the opening at the rear end thereof; a string holding piece which has a concave portion for holding the string therein and which is fixed to the case in a state wherein it is inserted into the case through the opening at the rear thereof so as that it can be laid over the string pressing piece; and a string which is folded at substantially the center thereof, which is held by the concave portion of the string holding piece in the case, and which forms double loops by two end portions thereof so as to tightly close an object to be sealed, intermediate portions of the end portions of the string being pressed by the string pressing portions of the string pressing piece.

BRIEF DESCRIPTION OF THE DRAWINGS

The drawings show two embodiments of the present invention.

DETAILED DESCRIPTION OF THE INVENTION

The embodiments of the present invention are described below with reference to the drawings.

Figure 1:
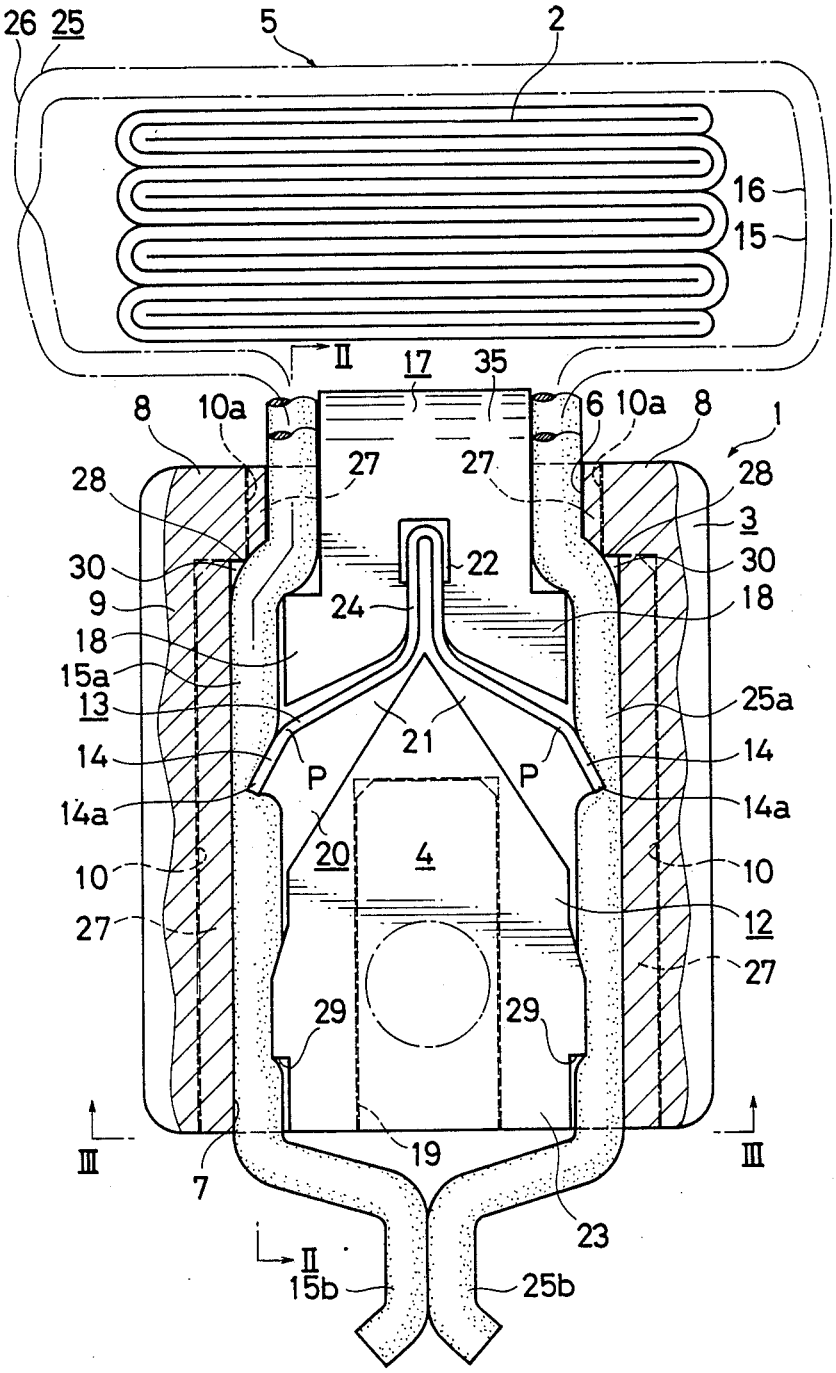
FIG. 1 is a partially cut-away enlarged plan view of a first embodiment of the present invention before a coin containing bag is sealed.
Figure 2:
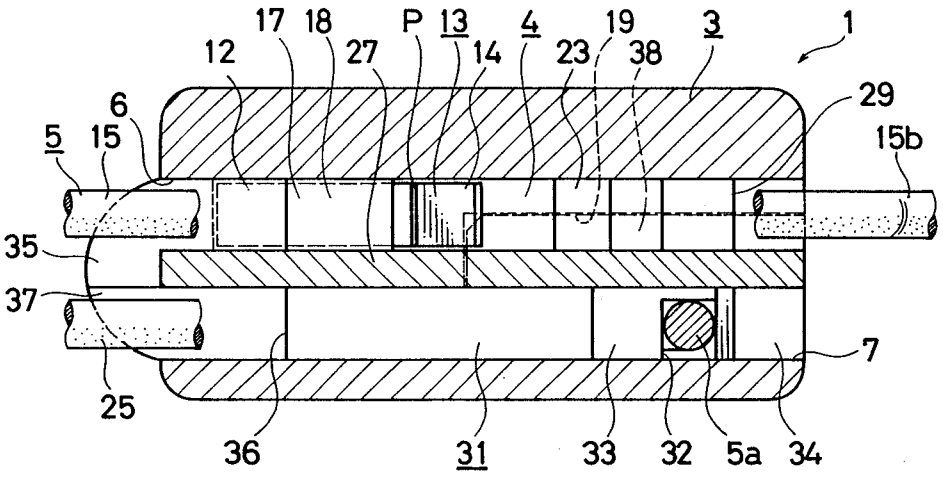
FIG. 2 is an enlarged sectional view taken along the line II—II of FIG. 1.
Figure 3:
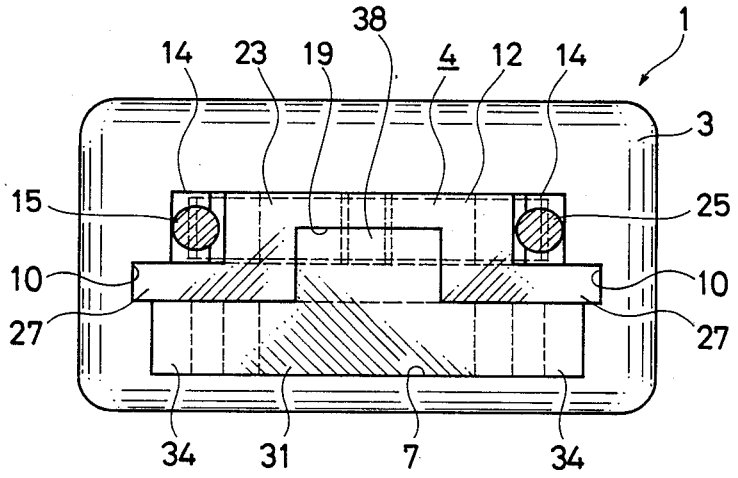
FIG. 3 is an enlarged sectional rear view taken along the line III—III of FIG. 1.
Figure 4:
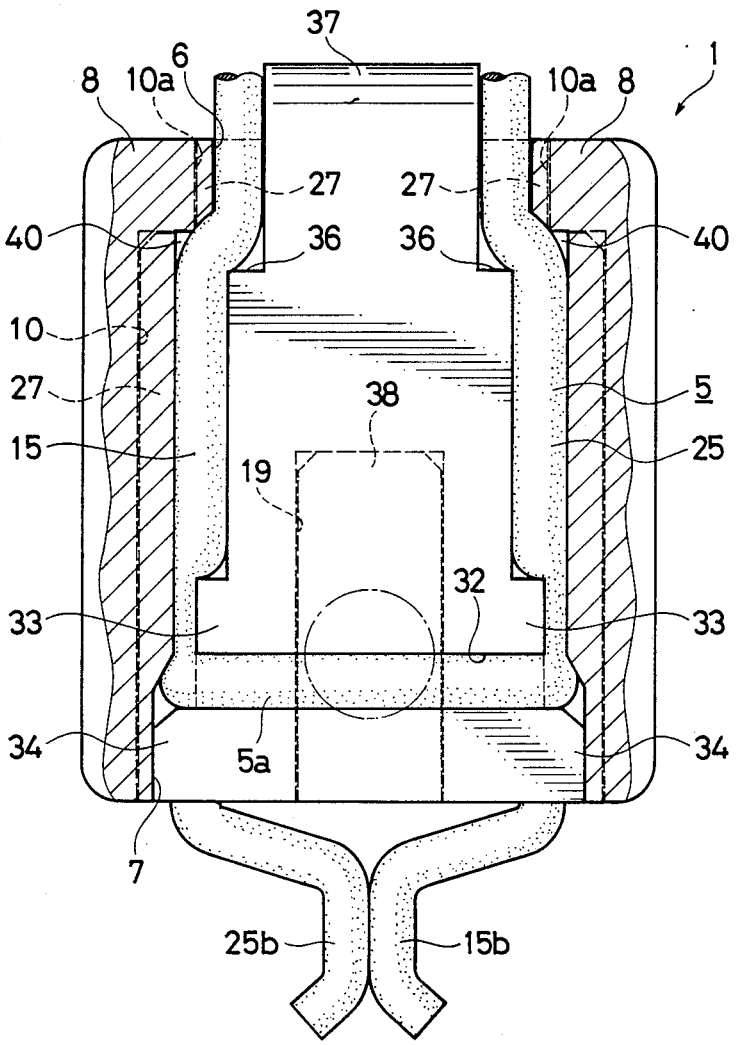
FIG. 4 is a partially cut-away enlarged sectional bottom view of the first embodiment of the present invention.
Figure 5:
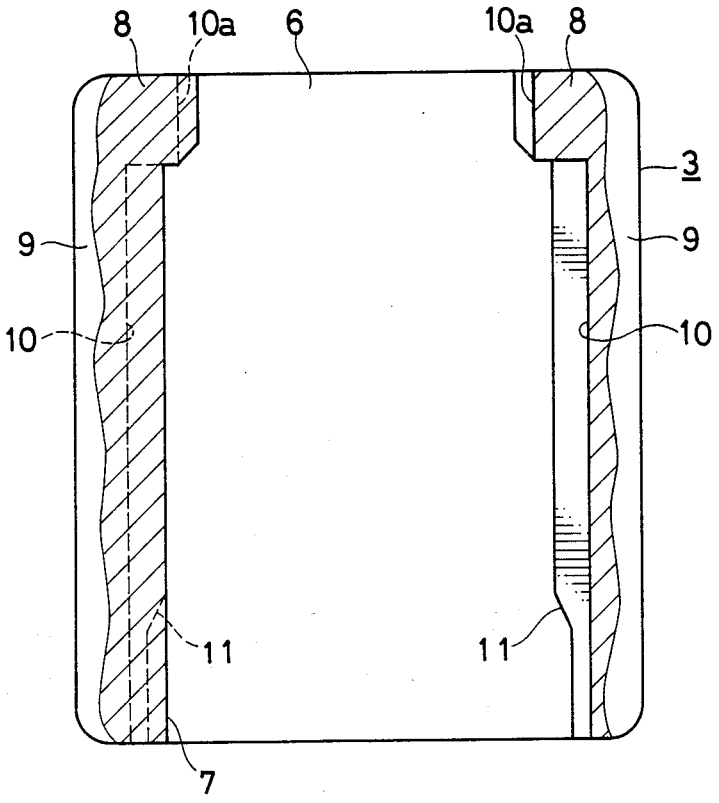
FIG. 5 is a partially cut-away enlarged plan view of a case.
Figure 6:
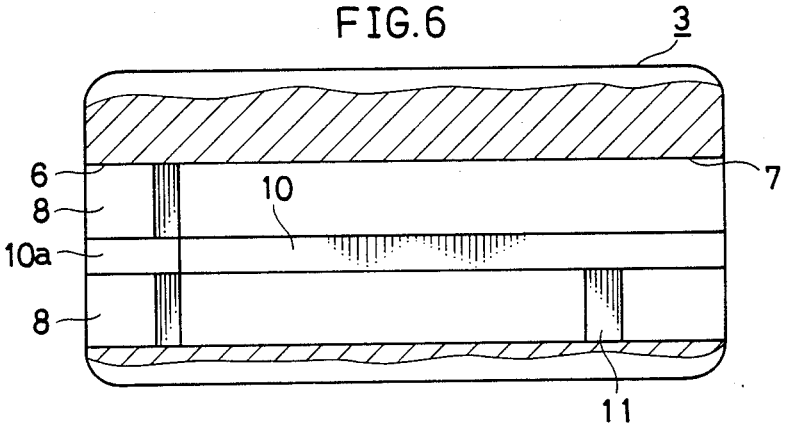
FIG. 6 is an enlarged side view of the same as viewed from the left.
Figure 7:
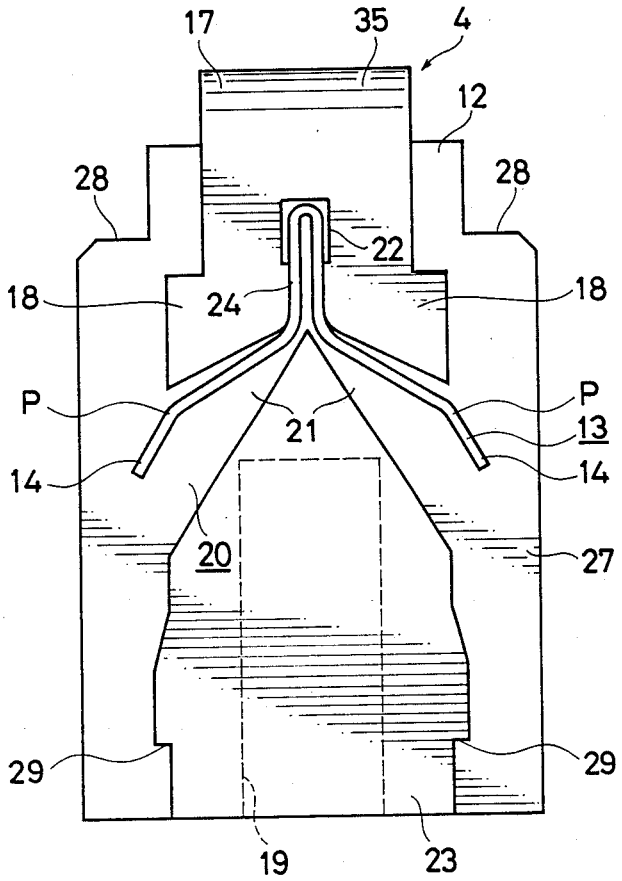
FIG. 7 is an enlarged plan view of a string pressing piece.
Figure 8:
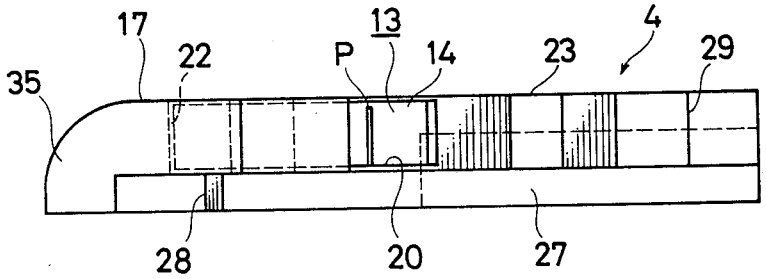
FIG. 8 is an enlarged side view of the same as viewed from the left.
Figure 9:
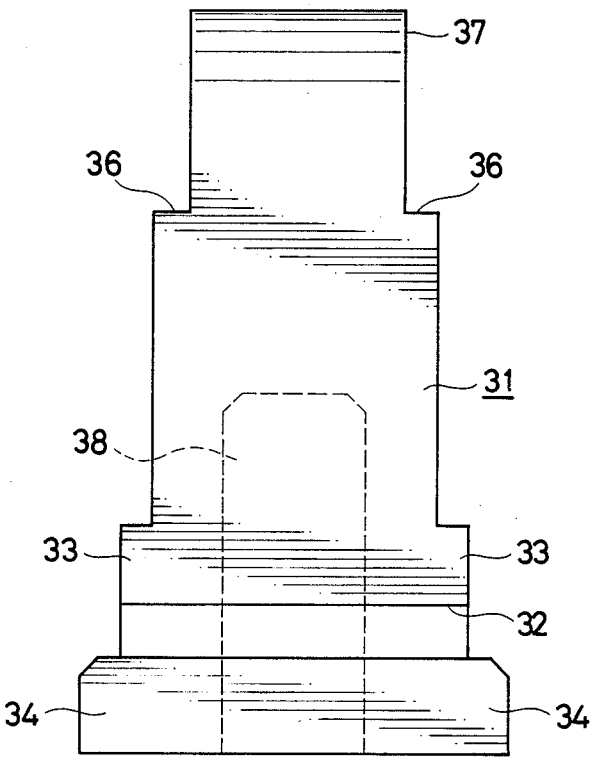
FIG. 9 is an enlarged plan view of a string holding piece.
Figure 10:
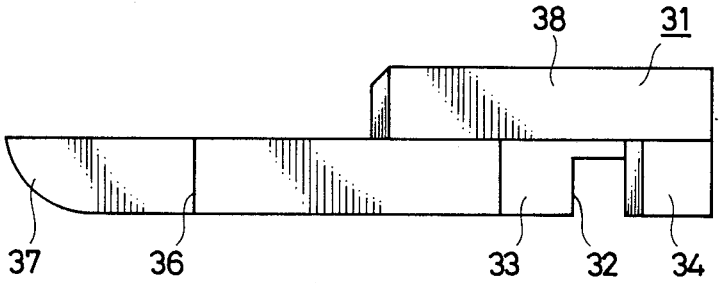
FIG. 10 is an enlarged side view of the same as viewed from the left.

In the specification, the terms "front and rear", "left and right" and "upper and lower" are based on FIG. 1, and it is assumed that the term "front" indicates the upper side of the drawing; the term "rear", the lower side of the same; the term "left", the left side of the same; the term "right", the right side of the same; the term "upper", the front side of the same; and the term "lower", the rear side of the same.

In FIGS. 1 to 10 showing a first embodiment of the present invention, a sealing device 1 for sealing a coin containing bag 2 or the like comprises a small box-shaped case 3 which has openings 6, 7 at the front and rear ends thereof and is made of a synthetic resin such as an ABS resin; a string pressing piece 4 which is received in the case 3 and is provided with a flat presser spring 13 having string pressing portions 14 at its left and right sides; a string holding piece 31 having a concave portion 32 for holding a string therein in a portion near the rear end of the case 3 and projecting walls 33 which prevent illicit extraction of the string and which are provided on the left and right sides in front of the concave portion 32; and a string 5 made of a synthetic resin such as nylon or hemp. The size of the case is, for example, about 18 mm long, about 16 mm wide, and about 9 mm high.

The case 3 has walls 8 which project inward and are provided on the left and right sides of the opening 6 at the front end, narrow guide grooves 10 which are provided horizontally at the centers of the left and right side walls 9 of the case 3, and guide grooves **10*a* which are provided horizontally at the ends of the projecting walls 8 so as to extend from the grooves 10. Step 11 are provided under the grooves 10 at the rear ends of the left and right side walls 9**, on the insides thereof.

The string pressing piece 4 is provided with a presser piece body 12 made of a synthetic resin such as an ABS resin and a flat presser spring 13 made of a stainless-steel plate.

The presser piece body 12 has a lower wall 27 made of a thin, substantially rectangular plate and steps 28 which are provided on the left ad right sides at the front end of the lower wall 27 so as to engage with the projecting walls 8 of the case 3. The presser piece body 12 also has a front wall 17 which is provided on the upper surface at the front thereof so as to be able to enter the center of the upper side of the opening 6 at the front end of the case 3, projections 18 projecting outward from the front wall 17 in the case 3, and a projection 35 for preventing looseness of the string which projects forward from the front wall 17 and has an upper surface having the cross section form of a circular arc. The presser piece body 12 has a rear wall 23 of a substantially pentagonal form which is provided on the upper surface at the rear thereof, the rear wall 23 having steps 29 which are provided on the left and right sides at the rear end. The presser piece body also has a concave engagement portion 19 which is provided on the lower surface at the rear thereof and which only opens rearward. A concave portion 20 in which the flat spring is engaged and which comprises left and right concave portions 21 each allowing the rocking of the top of the spring and each having a substantially triangular form in plan view, and a substantially U-shaped groove 22 connecting the concave portions 21 to each other, is formed in an intermediate portion between the front wall 17 and the rear wall 23 on the upper surface of the presser piece body 12.

The flat presser spring 13 comprises a substantially U-shaped folded portion 24 at the center and string pressing portions 14 which extend obliquely rearward like wings so as to gradually extend from the folded portion 24 to the left and right sides. The string pressing portions 14 are bent inward at 10° to 50°, preferably 20° to 40°, with respect to the direction of extension of the spring pressing portions 14 at points P near their ends, so that portions **14*a* thereof ahead of the bend points P press against the string 5** at acute angles.

When the string pressing piece 4 having the flat spring 13 is inserted into the case 3 from the opening 7 at the rear end in such a manner that the left and right edges of the lower wall 27 are engaged in the guide grooves 10, **10*a* of the case 3 and are guided thereby, crooked spaces 30 through which the string passes are formed between the projecting walls 8 at the front of the case with the left and right side walls 9 thereof and the front wall 17 with the rear wall 23 of the presser piece body 12**.

A string holding piece 31 is made of a synthetic resin such as an ABS resin and has a substantially rectangular form. The string holding piece 31 has a laterally lengthened concave portion 32 in which the string is engaged and which is provided in a portion near its rear end, projecting walls which prevent an illicit extraction of the string and which project outward in front of the concave portion 32, and projecting walls 34 projecting outward on the rear side of the concave portion 32.

Steps 36 are provided at the left and right sides in portions near the front end of the string holding piece 31, and a projection 37 which has a lower surface having the cross section of a circular arc, projects forward from the opening 6 at the front end of the case 3, and which prevents looseness of the string is provided at the front end of the string holding piece 31. A rectangular projection 38 which is longer in the longitudinal direction of the drawings, is provided at the center of the upper surface of the string holding piece 31 at the rear thereof.

When the string holding piece 31 is laid on the presser piece body 12 and is received in the case 3 in a state wherein the rectangular projection 38 is engaged in the engagement groove 19, crooked spaces 40 through which the string is passed are formed between the front projecting walls 8 with the left and right side walls 9 of the case and the portion before the concave portion 32 of the string holding piece 31 in which the string is engaged. The rear wall 23 of the presser piece body 12 and the string holding piece 31 are integrally bonded to the rear end of the case 3 by fusion by ultrasonic bonding.

The string 5 is folded at a substantially central portion thereof having a given length, and is held by the string holding piece 31 in a state wherein the folded portion thereof 5a is engaged in the concave portion 32 of the holding piece 31. A portion 15 at one end of the string 5 is passed through the crooked space 40 on the same side in the lower portion of the case 3 and is extracted to the outside from the front end thereof so as to form a first loop 16 for tightly closing the bag to be sealed. An intermediate portion **15*a* of the portion 15 is also passed through the crooked space 30 on the opposite side from the upper portion of the front end, and an end 15*b* thereof is extracted to the outside from the upper portion of the rear end of the case 3. A portion 25 of the string extending from the folded portion 5*a* is passed through the crooked space 40 on the same side in the lower portion of the case 3 and is extracted to the outside from the front end so as to form a second loop 26 for tightly closing the bag to be sealed. An intermediate portion 25*a* of the portion 25 is also passed through the crooked space 30 on the opposite side from the upper portion at the front end, and an end 25*b* thereof is extracted to the outside from the upper portion at the rear end of the case 3**.

The projections 35, 37, which prevent looseness of the string and have, on the whole, the cross sectional form of a circular arc, project from the front end of the case when the string pressing piece 4 and the string holding piece 31 are connected to each other. These projections have the function of preventing looseness of the string 5 caused by longitudinal rocking of the case 3 because the contact area between the coin containing bag 2 and the case is reduced when the bag is sealed. Therefore, the projections 35, 37 need not have a cross-sectional form of a circular arc, but may have a substantially triangular form.

The above-described sealing device 1 is, for example, assembled by the method described below. The string 5 having the given length is first folded at substantially the center thereof, and the ends 15*b*, 25*b* of the string 5 are arranged on the left and right sides, and then are bonded to each other. Alternatively, the ends 15*b*, 25*b* of the string 5 may be tied to each other. Then the folded portion 5*a* at the center of the string 5 is inserted into the case 3 through the opening 7 at the rear end thereof, and is extracted to the outside from the opening 6 at the front end so that most of the portions 15, 25 of the string are pulled out of the case 3. At the same time, the string pressing piece 4 having the flat presser spring 13 is inserted into the upper portion of the case 3 through the opening 7 at the rear end in such a manner that the left and right edges of the lower wall 27 of the pressing piece 4 are guided by the guide grooves 10, 10*a* of the case 3 and the portion 15, 25 of the string 5 are placed on the upper surfaces of the left and right sides of the lower wall 27, respectively. Then the portions 15, 25 of the string 5, which project outward from the opening 6 at the front end of the case 3, are twisted once so as to cross each other. The central folded portion 5*a* of the string 5 is then passed through the lower portion of the string pressing piece 4 in the case 3 from the opening 6 at the front end thereof, and is extracted rearward from the opening 7 at the rear end. In this case, since the folded portion 5*a* of the string 5 is inserted into the case 3 and is doubled back therein, the operation is very simple. Then the central folded portion 5*a* of the string 5 and the string holding piece 31 are inserted together into the case 3 from the opening 7 at the rear end thereof so that the central folded portion 5*a* of the string placed in the rear portion of the case 3 is engaged in the concave portion 32 of the string holding piece 31, and the portions 15, 25 of the string 5 are brought into contact with the left and right sides of the projecting walls 33. At this point, the engagement projection 38 of the string holding piece 31 is engaged with the concave engagement portion 19 of the string pressing piece 4 so that the string pressing piece 4 is laid on the string holding piece 31 in the case 3. In addition, the portions 15, 25 near the central folded portion 5*a* of the string 5 are firmly compressed between the projecting walls 33 which prevent illicit extraction of the string and which are provided on the left and right sides of the string holding piece 31 and the left and right side walls 9 of the case 3, so that the portions 15, 25 cannot move at all. The first loop 16 and the second loop 26 for tightly closing the bag are formed in front of the case 3. In this state, the case 3, the presser piece body 12, and the string holding piece 31 are bonded to each other by melt bonding to form the sealing device 1.

The coin containing bag 2 is sealed by the above-described sealing device 1 in the manner described below.

The first loop 16 and the second loop 26 of the string 5 of the sealing device 1 form a double loop around the case 3. The mouth of the coin containing bag 2 is placed in the first and second loops 16, 26. In this state, when the ends 15*b*, 25*b* of the string 5, which are placed outside the rear of the case 3, are strongly pulled, the size of the first and second loops 16, 26 is gradually reduced so that the mouth of the coin containing bag 2 is reduced by these loops 16, 26. When the size of the loops 16, 26 has been reduced to as small as possible, the intermediate portions 15*a*, 25*a* of the string 5 are tightly held by the ends of the string pressing portions 14 of the flat presser spring 13. In this state, the string 5 cannot be pulled out toward the coin containing bag 2, and the sealing of the bag 2 is thus completed.

In order to release the sealing provided by the above-described sealing device 1, the string 5 must be cut so that the closed first nad second loops 16, 26 are opened and the mouth of the coin containing bag 2 can be opened.

Figure 11:
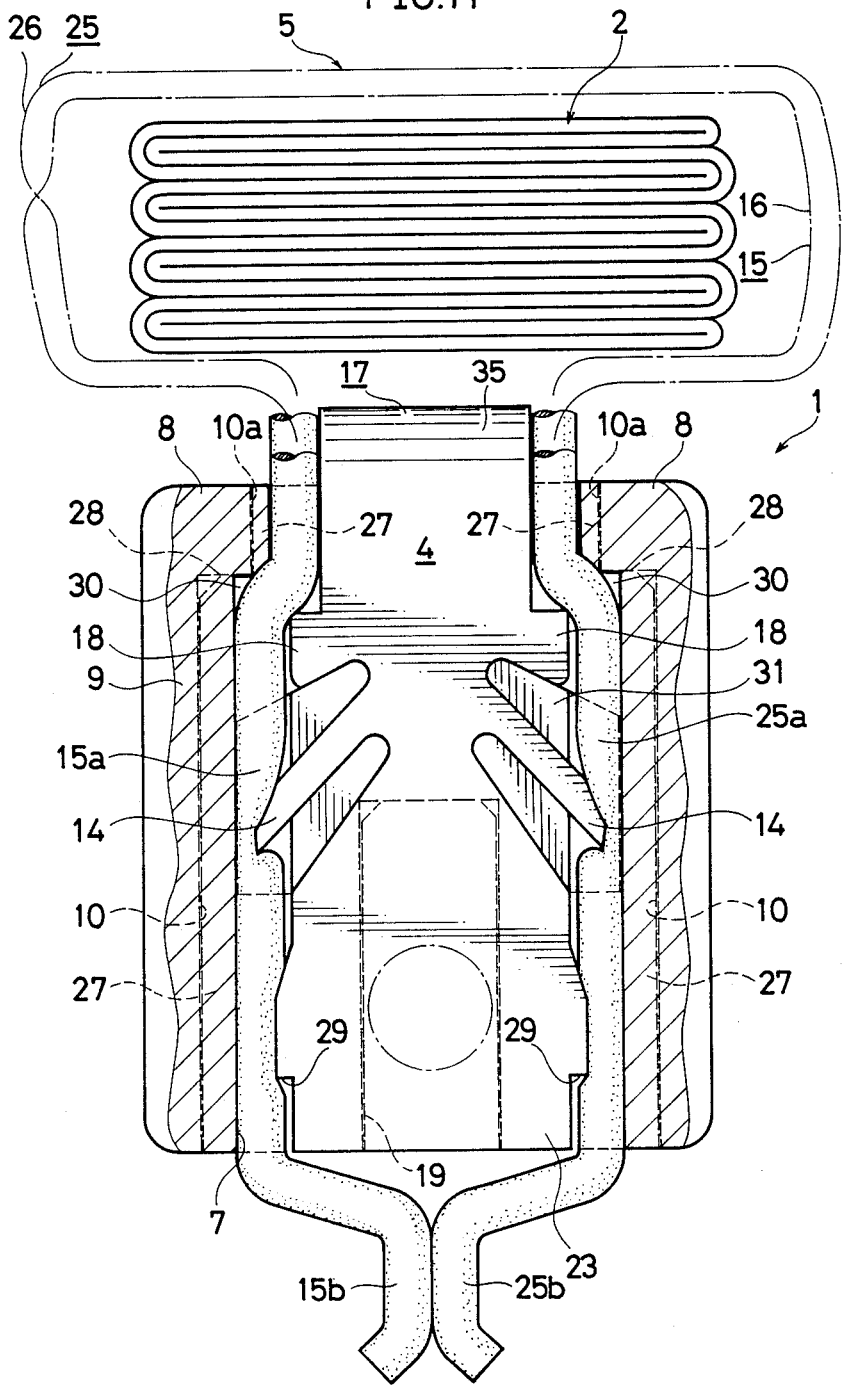
FIG. 11 is a partially cut-away enlarged plan view of another embodiment of the present invention before a coin containing bag is sealed.

FIG. 11 shows a second embodiment of the present invention. The second embodment differs from the first embodiment in that the string pressing piece 4 is a molded piece made of a synthetic resin such as Duracon, and the string pressing portions 14 that project outward are integrally provided on the string pressing piece 4.

Since the other portions of the second embodiment are the same as those of the first embodiment, the same portions are denoted by the same reference numerals in the drawing.

In each of the embodiments, the loops 16, 26 of the string 5 are wound only once around the mouth of the coin containing bag 2, but two or more loops 16, 26 may be wound around the mouth to seal the bag 2.

In addition, the above descriptin concerns only the application of the sealing device 1 of the embodiments to the sealing of a coin containing bag 2 used by a bank, but the sealing device 1 of the present invention is not limited to this and can be also used for sealing various bags such as bags for receiving mail.

As described above, the sealing device 1 of the present invention comprises a prismatic case 3 having openings at the front and rear ends thereof; a string pressing piece 4 which has string pressing portions 14 on its left and right sides and which is fixed to the case 3 in a state wherein it is inserted into the case 3 through the opening 7 at the rear end thereof; a string holding piece 31 which has a concave portion 32 in which a string 5 is held and which is fixed to the case 3 in a state wherein it is inserted through the opening 7 at the rear end of the case 3 so as to be laid over the string pressing piece 4; and the string 5 which is folded at substantially its center so as to be held in the concave portion 32 of the string holding piece 31 in the case 3, and which forms double loops 16, 26 for tightly closing an object to be sealed by portions 15, 25 on the left and right sides of the folded portion 5a, intermediate portions 15*a*, 25*a* of the portions 15, 25 being held by the string pressing portions 14 of the string pressing piece 4. Therefore, the sealing device 1 can seal an object such as a coin containing bag 2. In addition, since a large hollow portion in which the string pressing piece 4 and the string holding piece 31 can be received is formed in the case 3, it is very easy to pass the string 5 through the case 3 and assemble the case 3, the string pressing piece 4, and the string holding piece 31. Therefore, the sealing device 1 exhibits good operating properties and can easily be manufactured manually. Furthermore, since the sealing device 1 comprises a small number of constituent members, it can be manufactured at a very low price. The string 5 is held by the string holding piece 31 in a state wherein the central folded portion 5*a* is engaged in the concave portion 32 of the strong holding piece 31 in the case 3, so that the string 5 cannot be illicitly extracted from the case 3 and replaced with a new string. Thus, the sealing device 1 has the advantage of providing complete sealing.

What is claimed is:

1. A device for sealing a coin containing bag or the like article comprising:

a prismatic case having a through hole having openings at the front and rear ends thereof;

a string pressing piece having string pressing portions at left and right sides thereof and fixed within said through hold adjacent to said opening at the rear end thereof; and a string holding piece having a concave portion for holding a string therein and fixed within said through hole adjacent to said rear opening over said string pressing piece thereby constituting a unitary structure;

wherein said string is folded substantially at a center thereof so as to be held in said concave portion of said string holding piece in said case, and forms double loops for tightly closing an object be sealed by extending portions on the left and right sides of the folded portion, further extending portions of said string are held by said string pressing portions of said string pressing piece.

2. A device for sealing a coin containing bag or the like according to claim 1, wherein a second concave portion for holding said string therein is formed in the lower surface of said string holding piece.

3. A device for sealing a coin containing bag or the like according to claim 2, wherein a flat presser spring having said string pressing portion at both ends thereof is held by the upper surface of said string pressing piece.

4. A device for sealing a coin containing bag or the like according to claim 3, wherein said flat presser spring held by aid upper surface of said string pressing piece comprises a U-shaped folded portion at a center thereof, and said string pressing portions gradually extend outwardly from the ends of said central folded portion, portions near the ends of said string pressing portions being bent at predetermined angles with respect to the directions of extension of said string pressing portions so as to strongly press against said string at acute angles.

5. A device for sealing a coin containing bag or the like according to claim 4, wherein said case, said string pressing piece, and said string holding piece are made of a synthetic resin, and said string pressing piece and said string holding piece are inserted into said case and then melt-bonded together.

6. A device for sealing a coin containing bag or the like comprising:

a prismatic case having a through hole having openings at front and rear ends thereof;

a string pressing piece in which front and rear walls are projected from the upper surface of the lower wall of substantially rectangular plate to form spaces through which a string is passed, wherein a flat presser spring having string pressing portions projecting in said spaces for passing said string therethrough is held between said front and rear walls, and a concave engagement portion opened rearward is provided on the lower surface at the rear of said lower wall; and a string holding piece having a width smaller than that of said lower wall of said string pressing piece and having a second concave portion for holding a string therein in the lower surface thereof and a convex engagement portion engagable with said concave engagement portion of said string pressing piece in the upper surface thereof;

wherein said string is folded substantially at a center thereof so as to be held by said second concave portion for holding said string therein of said string holding piece in said case and forms double loops for tightly closing an object to be sealed by extending portions on the left and right sides of the folded portion, further extending portions are pressed by said string pressing portions of said string pressing piece;

said string pressing piece being inserted into said prismatic case through said opening at the rear end thereof in a manner such that said concave engagement portion of said string pressing piece engages with said convex engagement portion of said string holding piece.

7. A device for sealing a coin containing bag or the like according to claim 6, wherein said flat presser spring held by said upper surface of said string pressing piece comprises a substantially U-shaped folded portion at the center thereof, and said string pressing portions gradually extend outwardly from the ends of said folded portion, portions near the ends of said string pressing portions are bent inwardly at predetermined angles with respect to the directions of extension of said string pressing portions so as to press against said string at acute angles.

8. A device for sealing a coin containing bag or the like according to claim 7, wherein said case, said string pressing piece, and said string holding piece are made of a synthetic resin, and said string pressing piece and said string holding piece are inserted to said case and then melt-bonded together.

* * * * *